United States Patent [19]

Hussey

[11] 3,941,390

[45] Mar. 2, 1976

[54] HEEL AND TOE WEIGHTED GOLF CLUB HEAD

[76] Inventor: Douglas Hussey, 47 Woodridge Cres., Apt. 13, Ottawa, Ontario K2B 7T2, Canada

[22] Filed: Apr. 26, 1972

[21] Appl. No.: 247,760

Related U.S. Application Data

[63] Continuation-in-part of Ser. No. 83,501, Oct. 23, 1970, abandoned.

[30] Foreign Application Priority Data

May 3, 1971 Canada ..... 112016

[52] U.S. Cl. ..... 273/169; 273/167 F; 273/171; 273/172

[51] Int. Cl.[2] ..... A63B 53/04

[58] Field of Search ..... 273/77 R, 80 C, 167–175, 273/164

[56] References Cited

UNITED STATES PATENTS

| | | | |
|---|---|---|---|
| 873,423 | 12/1907 | Govan | 273/169 |
| 1,133,129 | 3/1915 | Govan | 273/171 |
| 1,269,745 | 6/1918 | Robertson | 273/172 |
| 1,289,192 | 12/1918 | Klin | 273/172 X |
| 1,349,806 | 8/1920 | Booth | 273/172 |
| 1,361,957 | 12/1920 | Bernays | 273/169 |
| 1,446,577 | 2/1923 | Nix | 273/171 |
| 1,473,528 | 11/1923 | Tootle | 273/169 |
| 1,538,415 | 5/1925 | Tootle et al. | 273/172 |
| 1,671,956 | 5/1928 | Sime | 273/172 X |
| 1,901,562 | 3/1933 | Main | 273/169 |
| 1,917,774 | 7/1933 | Ogg et al. | 273/167 F |
| 2,067,556 | 1/1937 | Wettlaufer | 273/171 X |
| 2,820,638 | 1/1958 | Morrison | 273/80 C |
| 3,042,405 | 7/1962 | Solheim | 273/167 G X |
| 3,191,936 | 6/1965 | Guier | 273/168 X |
| 3,212,783 | 10/1965 | Bradley et al. | 273/171 |
| 3,250,536 | 5/1966 | Moser | 273/169 X |
| 3,305,235 | 2/1967 | Williams | 273/169 X |
| 3,516,674 | 6/1970 | Scarborough | 273/169 |
| 3,655,188 | 4/1972 | Solheim | 273/80 C X |

FOREIGN PATENTS OR APPLICATIONS

| | | | |
|---|---|---|---|
| 12,743 | 7/1901 | United Kingdom | 273/80 C |
| 1,075,460 | 7/1967 | United Kingdom | 273/167 F |
| 211,781 | 12/1957 | Australia | 273/167 J |
| 7,279 | 4/1901 | United Kingdom | 273/167 F |
| 3,118 | 2/1908 | United Kingdom | 273/80 C |
| 16,070 | 7/1908 | United Kingdom | 273/169 |
| 27,874 | 11/1910 | United Kingdom | 273/172 |

*Primary Examiner*—Richard J. Apley

[57] ABSTRACT

A golf club head is formed having weighting material of a density greater than the density of the parent head material positioned at the sides of the club head to increase the inertia effect of the head. The weighting material can be arranged to increase the inertia effect of the head and at the same time shaped to locate the centre of gravity of the head in alignment with the shaft centre line. The invention also contemplates the pre-positioning of the weighting material at a specified distance from the bottom of the club head whereby the swingweight may be changed without either changing the overall weight of the club or the head and/or changing the shaft flex. The invention also provides a design of soleplate to increase the inertia effect when attached to a golf club head.

16 Claims, 32 Drawing Figures

HEEL AND TOE WEIGHTED GOLF CLUB HEAD

This application is a continuation-in-part application of my application No. 83,501 filed Oct. 23, 1970 now abandoned. This invention relates to the manufacture of golf clubs more particularly of the "wood" variety, for example, the numbers 1, 2, 3, and 4 woods.

However in some cases sets of golf clubs have been made including number 5 and 6 woods and it is within the scope of this invention to cover these cases, indeed, the invention is applicable to golf clubs generally.

The greatest problem faced by most golfers is that of controlling the direction of their wood shots, most players having a tendency to "hook" or to "slice". In many cases, this is due in part to the individual's type of swing, but it is also due in part to the design of the club.

Because the wooden clubs are longer than the iron clubs and more flexible they are more difficult to control, consequently the golfer has great difficulty in swinging into the ball with the face of the club correctly aligned to give a square impact.

Now, if the club can be designed to give the golfer more room for error in returning the club to the ball square, improved results would be obtained. In golfing parlance this would mean that the "sweet spot" has been made larger, that is, the golfer can hit more off-centre and still obtain reasonable results. In engineering parlance, it means that the club must be made with a head having a high rotational inertia which, as will be later explained can be related to the "area-moment of inertia", an engineering quantity designated I in standard engineering textbooks and measured in units to the fourth power, for example, $in^4$.

It is, therefore, an object of this invention to provide a golf club having an increased inertia effect consistent with the traditional shape of golf clubs thereby producing a golf club with a minimum tendency to twist due to an off-centre impact thereby facilitating directional control.

This is only part of the problem, however, and further considerations must be taken into effect. The forces which act during the golf swing have been speculated upon for a very long time but irrespective of what forces are acting, be they moments applied by the hands or merely centrifugal forces, the effect is the same, that is, the shaft bends under the applied forces. That the shaft bends can be shown quite easily by frozen high-speed action photographs.

The effect of this bending, also, is well known, that is, it opens or closes the face depending on the particular bend and this produces the wayward shot.

Now, some of the deleterious effects produced by this bending can be reduced, by arranging that a vertical plane taken through and along the shaft will essentially coincide with the centre of gravity of the club head.

It is therefore an object of this invention to produce a golf club which will facilitate greater consistency in directional control.

Consideration must be given to the relative volumes of parent material and the weighting material and consistent with traditional total club head weights, it is an advantage to have the maximum amount of weighting material available for re-distribution since it is the particular distribution of the weighting material, that gives the desired effect. One method of achieving this but not necessarily the only one is to adopt a shape smaller than the average driver shape, for example, a head corresponding to the shape of a 3 wood or at least, smaller than the conventional driver head and add sufficient extra weighting material to give an equivalent driver total weight.

This could have important psychological advantages. It is well known that golfers when greater accuracy is called for, sometimes resort to a smaller wood, for example, a 3 wood instead of a driver and by adopting the above procedure therefore, the golfer will have the psychological advantage of handling a club of the size and shape with which he connotes accuracy.

A further psychological advantage accrues in that when the golfer takes up a driver he generally connotes this with achieving the greatest possible distance and unconciously is physically geared to put out extra effort which, unfortunately, is more often than not expended at the wrong time and the wrong place. However, on taking up a preferred driver embodiment of this invention, his eye will tell him he is playing a 3 wood so that this unconcious striving for power is alleviated.

A further advantage accrues from the adoption of this preferred embodiment in that the total volume of the club head, as aforesaid, will be smaller than the conventional standard wood and the aerodynamic drag which can be considerable at impact speeds of around 100 m.p.h. will be reduced.

It is therefore a further object of this invention to provide a golf club which for the same expenditure of energy will achieve at least equal results in terms of length achievement as traditional woods and at the same time promote directional control.

Attempts have been made in the past to improve golf club design. One of which is particularly directed to wood clubs is Canadian Pat. No. 280,082 dated 1928 proposes having the center of gravity of the club coincide with the shaft centre line and proposes to do this by placing a single heavy block directly in line with the shaft. Obviously this procedure does not result in maximized the area moment of inertia and it is notable that this very early patent has not come into general use. The invention will now be described with reference to the undernoted drawings which are by way of being examples only and no limitations are implied or intended.

Figure 1:
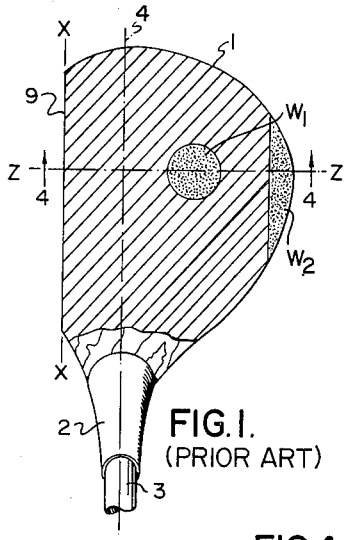
FIG. 1. (PRIOR ART)
FIG. 1 is a part sectional plan view of a prior art club showing weight distribution thereof.
Figure 5:
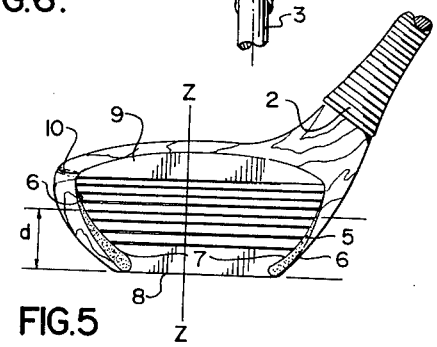
FIG. 5 is a front elevation of a further aspect of the invention.

A diagrammatic view of prior art clubs is shown in FIG. 1 where 1 indicates the general outline of the head of a wooden club, 2 is the hosel portion and 3 represents the shaft attached through the hosel by standard means. The axis X—X denotes a plane containing the striking face of the club or at least a part thereof and the axis Z—Z denotes the intended flight line, generally centrally located with respect to the striking face. For ideal conditions the striking face of the club should be perpendicular to the flight line at impact. From FIG. 5 it will be seen that the flight line Z—Z can, infact be considered a vertical plane since the flight line extends depthwise from the top to the bottom of the club head as shown in FIG. 5. The center-line of the shaft is denoted by 4 and it will be seen from FIG. 1 that by virtue of the placements of the weighting material W1 or W2 the center of gravity of the club will be displaced away from the shaft center-line towards the back end of the club. Obviously if the weight is disposed as shown by W2, FIG. 1 then the center of gravity is more displaced from the center-line of the shaft.

Figure 2:
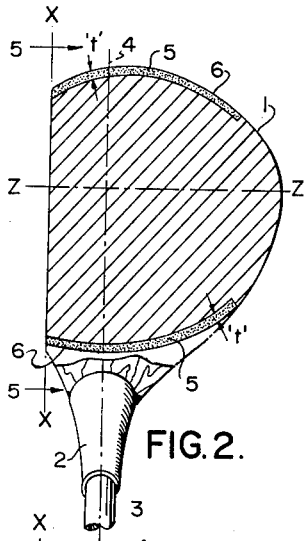
FIG. 2 is a part sectional plan view of one aspect of the invention.
Figure 4:
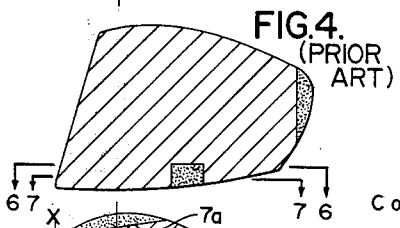
FIG. 4. (PRIOR ART)
FIG. 4 is a sectional elevation taken along the flight line Z—Z of FIG. 1.
Figure 3:
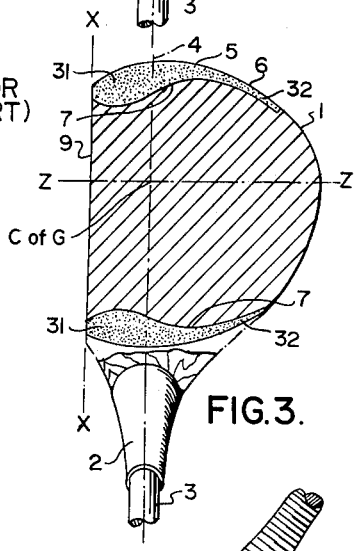
FIG. 3 is a part sectional plan view of a second aspect of the invention.
Figure 6:
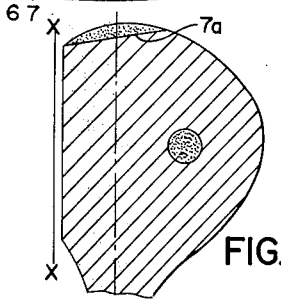
FIGS. 6 and 7 are part sectional plan views on 6—6 and 7—7 of FIG. 4.
Figure 7:
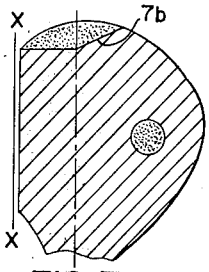

This invention envisages an entirely different configuration as shown in FIG. 2. The weighting material is inserted in the form of arcuate strips, at least one strip per side, having a curvature conforming to the outline of the club head and a chosen sectional thickness *t* see FIG. 2, the outer surface of the material being generally blended with the head shape. These strips can be inserted at any desired height from the sole line 8 which is shown in FIG. 5. Alternatively, the weighting material can be added in sheet-metal form and for the sake of achieving an increased area moment of inertia or inertia effect the material would be spread over as large an area as possible depending on the chosen length of the side portion 6, the chosen depth and the amount of the weighting material to be distributed. These parameters are chosen as to make the thickness *t* of the weighting portion a minimum, see FIG. 2, in other words the weighting material is placed as far away as possible from the flight line Z—Z, consistent with the outline of the head, thus the $h^2$ value in the formula, $Inn = Icg + Ah^2$ is maximized, giving an increased area moment of inertia. In practice the length of the side portion 6 will, of course, vary somewhat due to the multitude of golf club head shapes available but 50% to 75% of the total length from the front should give optimum results. It should be realised that a section through a driver or number 1 wood utilising the sheet-metal form of this invention could yield a view essentially similar to FIG. 2, that is, two arcuate strips, conforming to the outline of the club, each strip being the mirror image of the other and having, in this case, the chosen thickness *t*. It has been previously stated in this specification that it is an object of this invention to provide a golf club wherein a vertical plane passing through the shaft center-line will essentially co-incide with the centre of gravity of the club. It will be seen from FIG. 3 that by judicious shaping of the inner periphery 7, of the weighting material 5, the weighting material can be given a bias towards the striking face of the club X—X. Various outlines may be chosen to do this, for example the outlines **7*a* and 7*b*, shown in FIGS. 6 and 7 could be adapted to do this, and of course these outlines will also result in increasing the area moment of inertia over the prior art clubs. However, it is preferred to select the elongate outline as shown in FIG. 3 which is in the form of what might best be described as an arcuate "comet's tail" shape, with a first or head end and second or tail end 32, said head end designated 31**.

Of course, if it is desired not to have the centre of gravity of the club co-incident with the shaft center-line then the advantages of having an increased inertia effect may be achieved as heretofore shown and the center of gravity of the club may be positioned nearer the back of the club merely by reversing the head of the comet's tail, such that the bulk of the weighting material may be between the shaft center-line and the back of the club.

Heretofore in this application the principle of the invention has been described generally with reference to what might be called a top plan view. However it is well known that the point of impact of the club with the ball when viewed side on also has an effect on the quality of the shot. For example, if the centre of gravity of the club strikes the ball too far below the center of gravity of the ball a "skied" shot results, on the other hand if the club strikes the ball too far above the ball the tendency is to "top" the ball. (The words skied and top having the meanings generally attributed to them in golfing parlance). While a certain amount of topspin, produced by hitting above the ball's centre of gravity is advantageous in putting, it is believed a more efficient transfer of energy takes place when the centre of gravity of the ball and the club are in line. Thus, in putting, it is considered an advantage to get the ball rolling as quickly as possible which is attained by having the centres of gravity in line.

This invention may also be applied to vary the position of the centre of gravity from a fixed horizontal reference line, say, for example, the sole line 8, see FIG. 5. In this case the outline perimeter 9 defines the club striking face and includes peripheral side portions 6. As before, the weighting material 5 is disposed about the plane Z—Z at the extreme edges of the club and blended to the general outline. The inner periphery 7 of the strips or the sheet is again chosen or so shaped that the distance of the centre of gravity from the sole line 8 will be a pre-selected dimension *d*.

Figure 8:
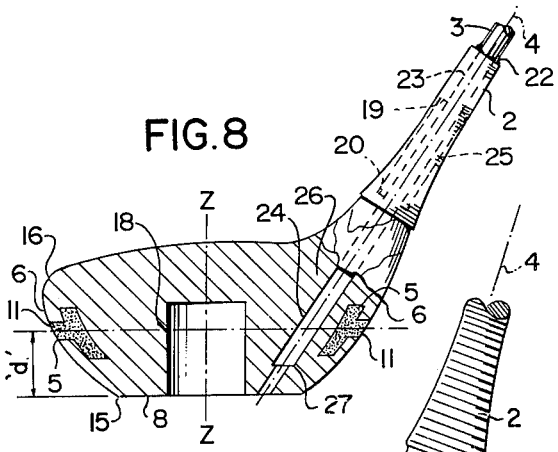
FIG. 8 is a part sectional elevation on 8—8 of FIG. 9.
Figure 9:
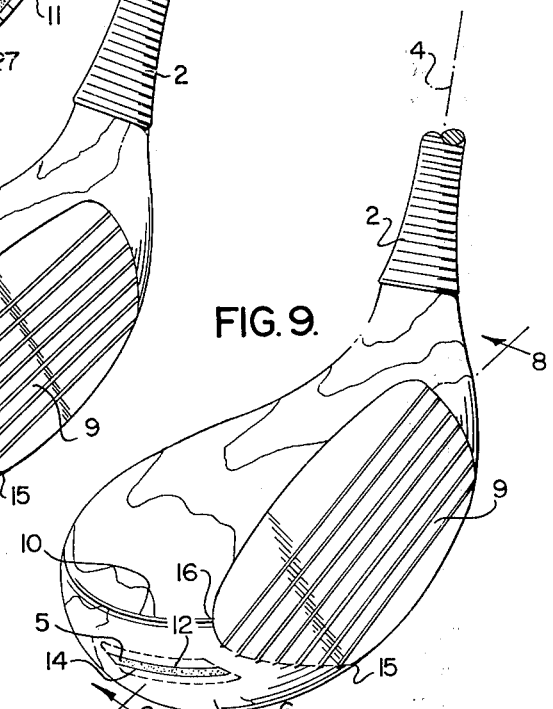
FIG. 9 is a perspective view of another aspect of the invention.

While the fixing of the weighting material may be done by various methods known in the art, for example, by screws or suitable adhesives, a convenient method is illustrated in FIG. 8 which represents a sectional elevation. The weighting material 5 is inserted in a "dovetail" manner, in this case in the form of a generally T shaped section, this helps to interlock the weighting material into the parent material, but screws may also be inserted if desired. The portion, 11 protruding through the parent material is blended to conform with the peripheral side portion 6. In this particular case, the shape of the weighting material protruding forms, as best shown in FIG. 9, a generally parallel strip having a top outline, 12 and a bottom outline 14 when viewed from the side, and extends a pre-selected distance along the peripheral side portion 6. From FIG. 8, it will be apparent that the distance of the strip material 5, from the sole line, 8 can be selected to pre-determine the position of the centre of gravity of the head from the sole line 8, since the weighting material is relatively more dense than the parent material, in this case, of course, the centre of gravity is in the vertical plane as opposed to FIGS. 1, 2 and 3 where the positioning of the centre of gravity refers to the horizontal plane. It will be appreciated that the inner periphery of the strip may be given any of the preferred configurations shown in FIGS. 2 and 3 or as mentioned above.

Figure 10:
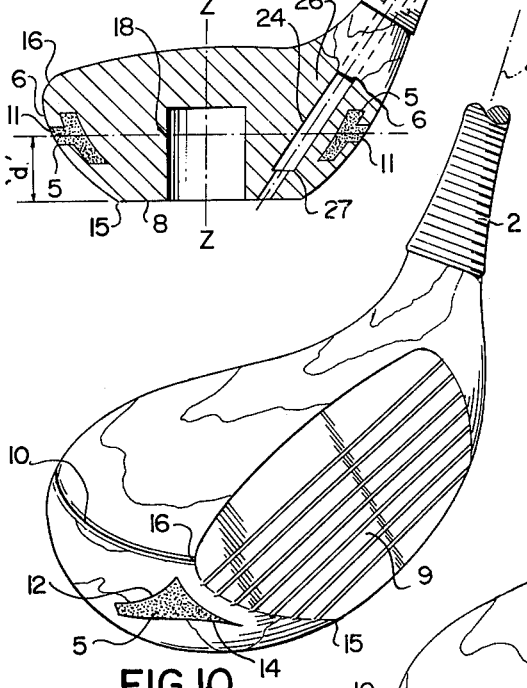
FIG. 10 is a perspective view of another aspect of the invention.

FIG. 10 illustrates an embodiment utilising a different form of weighting material. It has been previously stated that to achieve an increased area moment of inertia the weighting material 5 should have a constant or uniform thickness *t* see FIG. 2 and FIG. 10 illustrates how the weighting material, in this case, can be shaped to bias the horizontal centre of gravity towards the striking face, 9 of the club which face can have the usual slight wood curvature or be flat as desired.

In FIG. 10 the weighting material is shaped such that the upper outline, 12 and the lower outline 14, terminate at the outside surface of the club in a shape diverging towards the striking face of the club, thus biasing the center of gravity horizontally towards the center line of the shaft, 4, conversely, weighting material, 5 may converge towards the face. It will be appreciated that the top and bottom outlines 12 and 14 need not diverge or converge symmetrically and by choosing differing rates of divergence or slopes the position of the vertical center of gravity of the head may be influenced to move it either towards or away from the sole line, 8.

It is also pointed out that it is not strictly necessary to adopt a constant thickness *t* and the inner periphery 7, may be given any of the configurations shown in FIGS. 2 and 3 or mentioned elsewhere that is to say the shape of the weighting material when viewed side on may be combined with any of the inner peripheral configurations previously described. In this way the position of the center of gravity of the head may be made to be more or less co-incident with the shaft center-line.

The portions of weighting material 5, shown in FIGS. 9 and 10 are checked back slightly from the face of the club as opposed to that shown in FIG. 2 where the material, 5 is shown taken right through to the face, 9, this is merely a further method for achieving a greater fixing effect.

It will be apparent from FIGS. 9 and 10 that the weighting material need not take up the whole of the peripheral side portions 6 but only a part thereof. For example the peripheral side portion, 6 may be defined as consisting of the area bounded by the beginning of the top part of the club represented as the line 10, FIGS. 5, and 10, the line joining the points 15 and 16, FIGS. 8, 9 and 10 and, as previously stated, will extend backwards along the club for a distance of between 50 to 75% of the distance between the front and the back of the club measured from the front or striking face of the club depending on the particular configuration of the club. It will therefore be obvious that the weighting material 5 need not take up all of the area so defined but only a part thereof.

Figure 11:
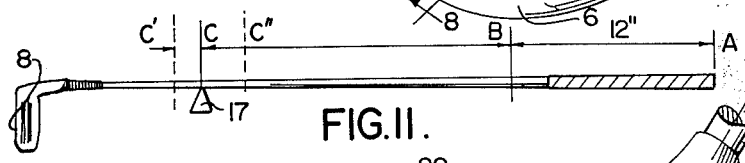
FIG. 11 illustrates the method of calculating "Swing-weight."

That aspect of the invention concerned with the capability of pre-determining the centre of gravity of the head in a vertical plane by placing the weighting material at pre-selected heights from the sole line on the peripheral side portion 6, constitutes a convenient method of adjusting or producing a club having a pre-selected "swingweight". One method of finding the swingweight of a golf club is illustrated in FIG. 11. The club is balanced on a knife-edge fulcrum 17, and the distance from the grip end, A to the balance point C, is measured. The point B is situated 12 inches from the grip end A and the distance BC is multiplied by the total weight of the club to give a quantity in ounces inches which will correspond to a swingweight reading on the lorythmic scale as is known.

Figure 32:
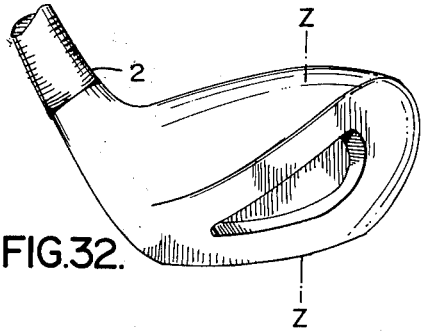
FIG. 32 is a view looking on the back of a club head showing an external cavity.

Now, it will be obvious that if the centre of gravity of the head is moved closer to the sole line, 8 then the club will require to be moved to the right, as viewed in FIG. 11, to take up a new balancing point C′. Conversely if the centre of gravity of the head is moved away from the sole-line, 8 then the club will require to be moved to the left to take up a new balance point C″. In either case the alteration of the distance BC will give a slightly different swingweight, further, different swingweights may be achieved through the variation in the length BC by pre-arranging the distance of the centre of gravity of the head from the sole line 8, and at the same time the overall weight of a given club may be maintained substantially the same and changes in shaft characteristics can be obviated. This may be done as follows:

Considering FIG. 8 and assuming for the moment that the weighting portions 5 are omitted, that is, the head is composed wholly of some parent material, for example wood. Some of the wood is removed to form a cavity 18. Further, portions of weighting material may be placed at pre-selected distances from the sole-line, 8, and since the weighting material is relatively denser than the parent material the particular positioning of the weighting material on the peripheral side portions, 6, from the sole line 8 will greatly affect the position of the centre of gravity of the head in the vertical plane, that is, relative to the sole line 8. A further internal cavity or void, 25, may be provided in the hosel portion 2, or an external cavity may be formed in the rear of the head as shown in FIG. 32 thus allowing more weighting material to be placed as desired. Alternatively, the head may be pre-formed with the cavity or cavities already in it and the weighting material positioned to give the desired effect, the amount of weighting material being chosen to keep the total weight of the club within desired limits. It should be noted that the removal of the parent material in this manner is simply a convenient method for allowing more weighting material to be added and distributed as desired in all embodiments.

It should be noted that this balancing of the club is not merely a matter of adding or subtracting weight to the head to make the overall weight of the club heavier or lighter but is concerned with providing the club with a particular "feel." The feel of a golf club is a very difficult term to define, but generally speaking it means the impression a golfer gets when he uses the club and involves such factors as how heavy the club feels, how whippy or stiff it feels, how much the golfer senses the head as he swings it and so on and the feel depends primarily on such factors as head weight and its distribution, the shaft modulus and weight and how this varies along the shaft, the length of the shaft and the material of which the shaft is made and changing the feel heretofore normally required changing either the head weight and/or shaft characteristics.

One method of measuring feel is that described above known as "swingweighting" and the range of swingweights using the lorythmic scale includes from C0 to E5, the most useful range, however, probably lies in the range C5 to D7.

A further method of measuring feel is that disclosed in U.S. Pat. No. 3,395,571 issued Aug. 6, 1968 to M. L. Murdoch which consists of measuring the natural frequency of vibration of the club head when given an impulse and the grip end is clamped. The useful range of frequencies according to this patent is from 250 to 400 cycles per minute.

It is therefore pointed out, that when the term feel is used in this specification it can refer to either of the two above described methods of measuring feel.

Generally speaking the cavities may be given any suitable configuration, however for the cavity in the hosel portion, it is preferred that it be in the form of a figure of revolution about the shaft axis 4. It will be noted from FIG. 8 that the top portion, 22 of the hosel forms an annular surface or seat for a ferrule (not shown) and that bearing portions 23 and 24 extend lengthwise to form circuferentially extending bearing surfaces for supporting and fixing the shaft, 3 against the forces set up during play. The cavity 25, lies between an upper limiting position 19 and a lower limiting position, 20 and if desired, the cavity or void 25 may extend partially into the main body portion, 26. The shaft, 3 may extend through to the sole line, 8 and be plugged as known in the art, or it may be checked back as shown at 27, again known in the art. The shaft, 3 may be force fitted to the hosel and pinned and/or a bonding agent may be interposed between the bearing surfaces and the shaft, such methods of fixing being known.

It is pointed out that no particular sequence of steps is necessary but in most cases, it is convenient to start by first lightening the head, thus the amount of weighting material may be determined and then distributed to give the desired effect. It is further pointed out that the formation of the various cavities must be done having regard to the structural strength of the head in order that the club may withstand the forces to which it is subjected during play.

Figure 12:
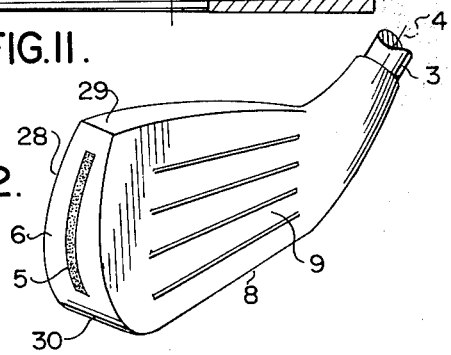
FIG. 12 is a perspective view of an iron or putter according to the invention.

Heretofore this invention has been primarily directed to clubs of the wood type, however clubs of the "iron" type, that is those clubs normally used between the tee and the green, and putters which are used on the putting green are known where the heads are constructed of dissimilar materials, for example U.S. Pat. No. 3,250,536 issued May 10, 1966 to R. C. Moser discloses an iron club having a basically aluminum head and wherein weighting material of a relatively denser material such as brass or the like is used for weighting purposes, it is also known that sets of irons made of brass have been made. Obviously, therefore, the principles set out herein may be applied to these clubs. In the case of irons however because of the relative thinness of the blade compared to the configuration of the conventional wood shape, the aforesaid limitations relating to the length of the peripheral side portions, would not apply and the weighting portions would extend probably through to the rear of the club. It is also pointed out that in the case of irons, the Rules of Golf as presently framed prohibit the use of iron clubs which have inserts in their faces, such clubs are illegal. This does not mean that they are illegal in the criminal sense, merely that in any golf competition played subject to the rules of golf as presently framed the use of iron clubs having inserts in their faces would not be sanctioned and it would be advisable not to have the weighting material extend through to the front face. It is also pointed out that irons made of the softer metals are much more liable to marking and indentation than golf clubs having conventional steel heads, this is much more noticable, for example, in the case of putters. It is believed, however, that such indentation is not so much due to the impact of the club head and ball but is caused primarily because of the collision of the various club heads as they are carried about the course during play. Such clubs, therefore, preferably should be protected by suitable covers such as are used to protect golf woods and putters. FIG. 12 represents a pictorial view of an iron or putter head according to one aspect of this invention. The weighting material 5, is, in this case, in the form of a vertical strip, shown hatched, and forms part of the peripheral side portion, 6. In this particular case the weighting material is embedded in the peripheral side portion and completely surrounded by the club head parent material, the weighting material 5, may, however extend to the rear portion of the club 28, it also may extend upwards to appear at the top portion, 29, and/or downwards to bottom portion 30 which in most cases is in the same plane as the sole line, 8. In the FIG. 10, however, the weighting material is shown spaced vertically from the sole line 8. It is not apparent from the FIG. 12, but the opposite side, that is, the hosel side has weighting material inserted therein of a configuration similar to that chosen for the "toe" portion, this applies equally to FIGS. 9 and 10 where only the weighting portions at the toe portions are shown. It will be seen from FIG. 12 that the peripheral side portions or the heel and toe are of curvilinear configuration as are those of the woods shown in FIGS. 9 and 10, but, and more particularly in the case of putter, the heel and toe may be of planar configuration. Also it will be appreciated that whereas in the figures the hosel is shown as an integral part of the main body portion this may be dispensed with in the case of putters and in this case the shaft attachment means simply takes the form of a drilled hole. In some cases the curvature mentioned above may be double, that is the heel and toe may curve in the horizontal plane and in the vertical plane.

It is pointed out that in the matter of practical golf club manufacture it may not always be possible or desirable that the club should have the maximum possible area moment of inertia. For example, it has previously been shown in this specification how the center of gravity of the club may be biased towards any away from the shaft center-line an in this case, obviously, the maximum possible area moment of inertia would not be achieved. In other cases, for example, very deep faced clubs putting the weighting material on the hosel side portion at the same height from the sole line as the peripheral side edge portion on the toe may result in having the weighting material at a position on the hosel which would seriously detract from the strength of the hosel. The terms "maximized area moment of inertia" and "maximum possible area moment of inertia" therefore, have been used freely and somewhat interchangeably throughout this specification, although it is recognised that strictly speaking the two terms are not quite synonymous. Therefore, it is pointed out the term "maximized area moment of inertia" refers to a club head wherein the maximum possible area moment of inertia has been achieved having regard to practical design limitations and the attainment of other desirable properties in a club.

Figure 13:
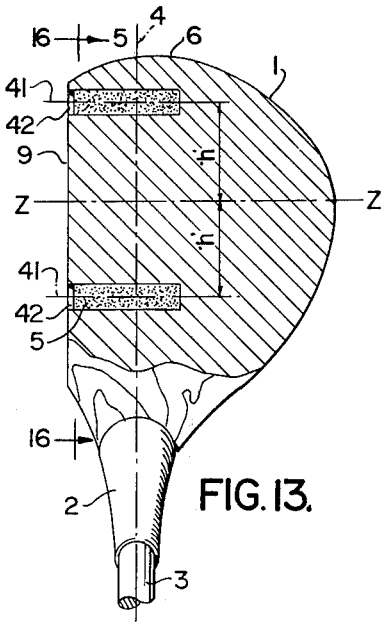
FIG. 13 is a part sectional plan view of an embodiment having weighting portions extending substantially parallel with the flight line Z—Z.
Figure 16:
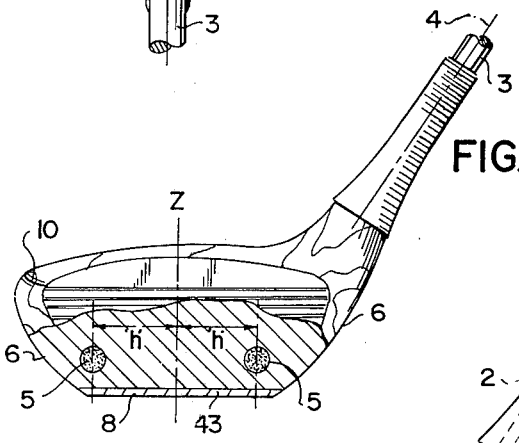
FIG. 16 is a part sectional elevation on 16—16 of FIG. 13.

FIG. 13 represents a further aspect of the invention in which the weighting portions 5 define a major axis 41 longitudinally extending parallel with the flight line Z—Z. The cross-section of the weighting portions can be circular as shown in FIG. 16 which represents a view looking on the striking face of the club head of FIG. 13. It will be appreciated that the longitudinal configuration will give a greater inertia effect since from a comparison of FIGS. 13 and 16, it will be seen that the centroid distance *h* in both cases is the same but the area of the longitudinally extending weighting portion, 5 of FIG. 13 will give an increased area, thus the quantity $Ah^2$ will be greater with this configuration. It will be seen from FIGS. 2 and 3 that the weighting portions, 5 also define a major axis longitudinally extending substantially parallel with the flight line, at least to the extent permitted by the curvature of the side portions 6. Further, it will be evident that elongate narrow weighting elements can be placed farther from the flight line giving a greater inertia effect.

In FIG. 13, the weighting portions 5 are stepped back slightly from the face 9 and this space may be filled with a covering 42 for appearences sake, this may be done throughout all the embodiments if desired.

Figure 14:
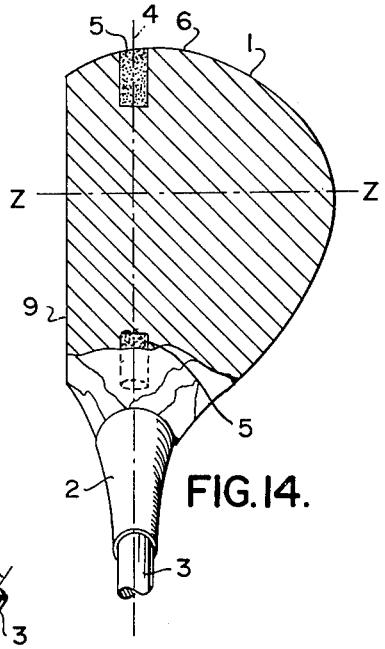
FIG. 14 is a part sectional plan view of an embodiment showing weighting portions extending parallel with the shaft center-line 4.

FIG. 14 shows an example embodiment where the weighting portions, 5 lie on an axis extending parallel, to the shaft center-line, 4. It is not neceasary that the weighting portions, 5 be placed exactly on the shaft center-line, 4, merely that they are positioned to give the desired effect. In all of the embodiments shown in FIGS. 13, 14 and 15, in addition to increasing the inertia effect of the club head, the weighting portions may, if desired, be arranged to form means whereby the center of gravity of the head is positioned in alignment with the shaft axis.

Figure 15:
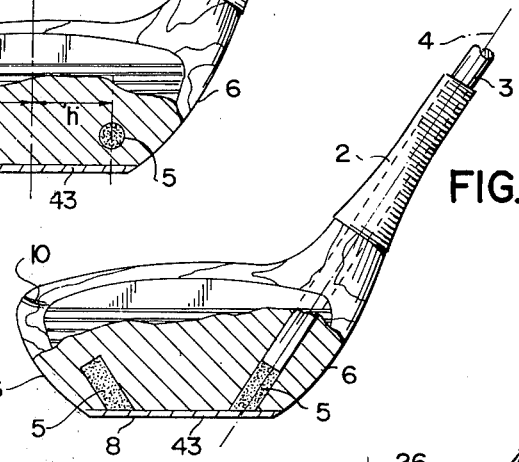
FIG. 15 is a part sectional elevation of an embodiment having weighting portions angled one to the other.

FIG. 15 shows an embodiment where the weighting portions, 5 are positioned at an angle to one another. The weighting portion, 5 adjacent the hosel side of the club head being positioned on the shaft center-line, though not necessarily to the same diameter as is shown in FIG. 15. This is advantageous in that a hole for the shaft, 3 has to be drilled anyway and the weighting portions, 5 can be covered by a sole plate, 43 attached by standard means during the club assembly.

Figure 18:
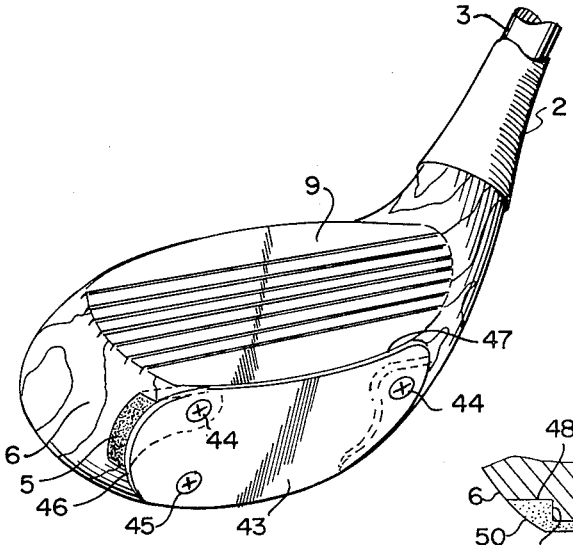
FIG. 18 is a perspective view on the underside of a club head according to another aspect of the invention.

FIG. 18 represents a view looking on the underside of a golf club head and shows a soleplate generally indicated at 43 on the bottom thereof, the major portion of which forms a surface for grounding the club during play. Weighting portions, 5 are set into the peripheral side portions 6 and the assembly, club head and soleplate can be conveniently assembled together using standard means, for example, screws 44, and additional screw or screws 45 may be used if desired as additional fixing means for the soleplate. It will be seen that the soleplate is not an integral part of the weighting portion, 5 or the main body portion 26 of the club head being separated therefrom at the junction represented by the line 46 which follows the contour of the head and the portion 47 represents the striking edge of the soleplate corresponding to the striking face of the club head.

Figure 19:
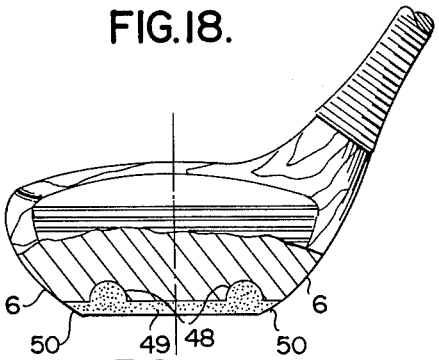
FIG. 19 is a part sectional elevation of a soleplate embodiment according to the invention.
Figure 20:
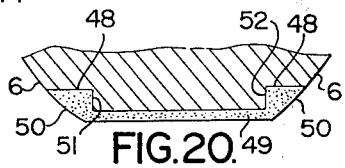
FIGS. 20, 21, 22 and 23 are part sectional elevations of different soleplate configurations according to the invention.
Figure 21:
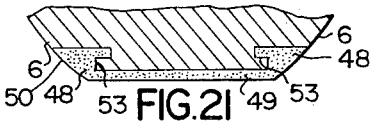
Figure 22:
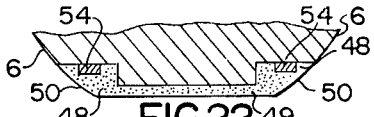
Figure 23:
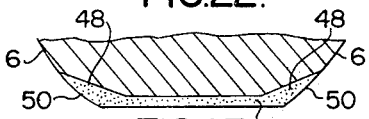
Figure 24:
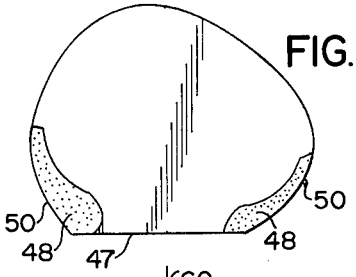
FIGS. 24, 25 and 26 are plan views of soleplates according to the invention.
Figure 25:
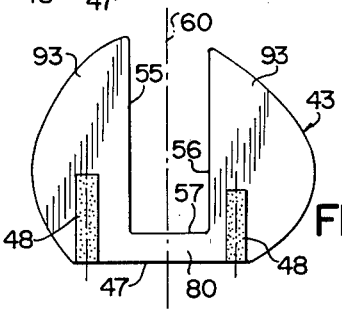

The soleplate 43 may be made having the weighting portions 5, forming an integral part thereof. FIGS. 20, 21, 22, and 23 represent various sections which the soleplate may have and they all have the common feature of including upstanding thickened portions, 48 in contrast to the main body portion 49 which thickened portions serve to give the desired weight distribution when the soleplate is attached to the club head. In FIG. 19, the weighting portions, 48 are curved in form and situated adjacent the peripheral side portions 50 of the soleplate. FIGS. 20, 21 and 22 show the thickened portions situated at the peripheral side portions, 50 of the soleplate which conform in shape with the peripheral side portions 6 of the club head. Outlines 51 and 52, FIG. 20 conveniently form a recess with main body portion 49 serving to locate the soleplate laterally on the club head. Outlines 51 and 52 can be slotted as at 53, in FIG. 21 to form a convenient means for mounting the soleplate on the club head in dovetail fashion. FIG. 22 shows a recess 54 which can be made in the thickened portions 58 and can serve as a receptacle to contain further weighting material, for example, if the parent material of the soleplate is of brass or aluminum the further weighting material can be lead. This gives a useful method of finally determining the weight distribution of the soleplate and thus of the golf club. FIGS. 24 and 25 represent the plan views of a soleplate and it will be obvious that the thickened portions 48 may be given any of the configurations of the weighting portions previously described and, also, as for those previously, described configurations, FIGS. 24 and 25 show, that for the soleplate, the thickened portions 48 corresponding to the weighting portions 5 of the club head, are concentrated at a locality adjacent the sides and front respectively. FIG. 25 shows how the soleplate, 43 may be produced to have a slot therein defined by the inner lines 55 and 56 and the line, 57 which is situated just back from the edge 47. The portion or bar 80 of the soleplate lying between lines 47 and 57 being just wide enough to effectively resist the forces which may arise during play, for example, if the golfer accidentally digs into the turf. This configuration increases the rotative inertia effect of the soleplate which as previously described is increased when the material is displaced away from the central longitudinal axis, 60 which corresponds to the flight line Z—Z when the soleplate is assembled to the club head. A rectangular slot is shown however, it will be appreciated that the bifurcated configuration is not restricted to a rectangular outline, moreover it will be observed that the bar 80 joining leg portions 93 is considerably less in width than the width of the leg portions 93 and the width of the soleplate is greatest at about the mid-point of the length.

Figure 27:
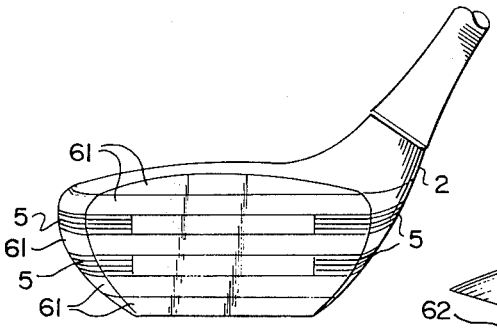
FIG. 27 is a front elevation of a laminated club head according to another aspect of the invention.
Figure 28:
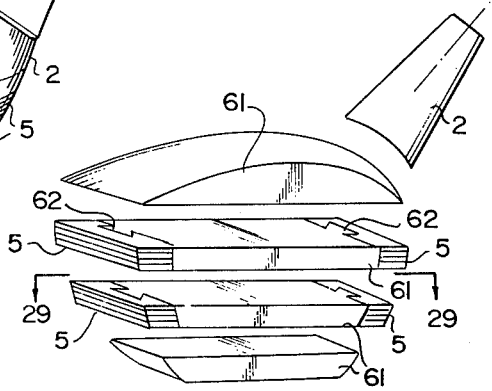
FIG. 28 is an exploded view of the club head illustrated in FIG. 27.
Figure 29:
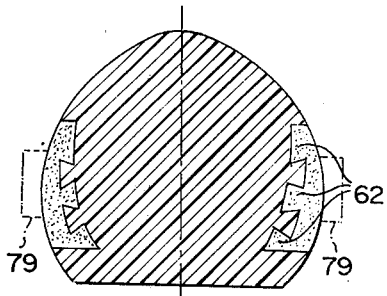
FIG. 29 is a view looking on 29—29 of FIG. 28.

As is known in golf club manufacture, heads for wood clubs may be made from layers of plastics material laminated together and the technique and materials from which this type of head can be made, also, are known, FIGS. 27, 28 and 29 illustrate a method of practising the invention using this type of club head construction. Layers, 61 of suitable plastics material, for example, cellulose acetate butyrate or other thermoplastic resin material, not restricted to being cellulosic in nature, are formed one upon the other in successive layers as will be evident from FIG. 27. These layers are treated with a suitable solvent, for example, such as acetone or the like which softens them and by the application of suitable pressure and temperature the layers are fused together into an integral wood head, the hosel portion, 2 being added later, see FIG. 28, the procedure above being known in the art. In applying the principle of this invention in this particular type of club head construction, weighting portions 5, best shown in FIGS. 28 and 29 are attached to preselected layers by means of dovetail portions, 62 and perforations may be also added which assist in the forming of the head into an integral mass. The weighting portions, 5 in this case can be conveniently formed from sheet metal. As will be evident from FIG. 27 although a plurality of weighting inserts are shown located in the main body portion each said locality is adjacent the heel and toe respectively of the head.

In addition to heads of laminated plastics material, heads of moulded plastics material and the techniques for moulding them are known in the art. Briefly this comprises injecting suitable plastics material under pressure into a mould and this invention may be practised using such known techniques. For example, the addition of a small tab, 79, FIG. 29, to the insert forms a conventient means for securing the insert between two halves of a suitable mould. The plastics material is then inserted into the mould in the known manner resulting in a club head having the weighting portions moulded in situ. On removal from the mould the tab may be removed and the head, including the insert polished up in a standard polishing procedure. If desired and depending on the shape of the mould, the inserts can be inserted from the bottom.

Figure 30:
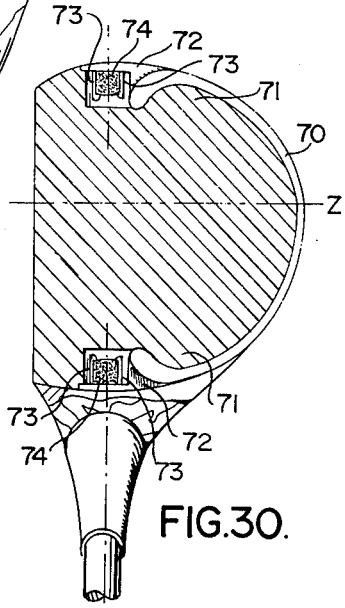
FIG. 30 is a part sectional plan view of the club head illustrated in FIG. 31.

FIG. 30 illustrates a method of providing a golf club head having adjustable weighting means.

Figure 31:
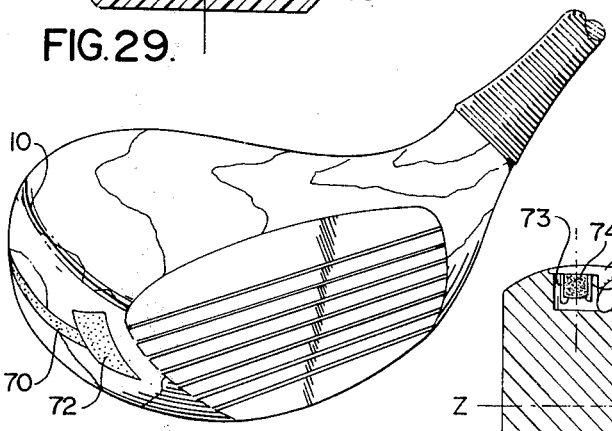
FIG. 31 is a perspective view of a club head according to another aspect of the invention. k

A restraining member, generally indicated at 70, extends around the back of the head. In this case the restraining member is of resilient material and forms a member rather similar to an industrial type spring retaining clip. The resilient member 70 may be sprung apart to allow it to pass over the two humped portions 71 and because of its inherent resiliency will tend to snap back again effectively retaining it against the club head. Attached to the member 70 are two basic planar portions 72, best seen in FIG. 31 which carry springlike prong portions, 73 capable of resiliently holding further portions of weighting material, 74. It may be arranged that the members 72 can be adapted to give the desired weighting effect and the weighting portions 74 can be removed and/or other portions differing in weight and/or density may be substituted depending on the desired effect. It will be appreciated from FIG. 30 that because of the relative thinness of the restraining member 70 the main inertia effect will lie in the planar portions 72 and/or the additional weighting portions 74. Alternatively the member 70 may be permanently set into the back of the head or removed altogether, in this case, the planar portions 72 may be hingedly attached to the club head and retained in conformity with the peripheral shape of the club by a torsion spring member. In both cases it will be appreciated that this provides a club head to be used in the construction of a golf club having an adjustable swingweight facility. This particular embodiment is useful in that it does not entail having to carry special tools such as a screwdriver or the like to unscrew members used to retain the adjustable weights in known designs.

The portions of weighting material may be inserted into the club by drilling out or otherwise forming cavities of the desired configuration and pouring in lead or such like weighting material, standard fixing means, for example screws, being added, if desired for greater security. Alternatively the weighting portions may be formed as articles of manufacture for example by casting.

It will be appreciated that the provision of heads as described herein are to be used subsequently in the manufacture of golf clubs and it is pointed out that it will be the overall weight of the particular golf club which will largely determine the desired weight of the basic head. This overall weight, of course, depends on such factors as the weight and type of shaft, the weight of the grip and soleplate and having determined the desired overall weight of the club the weight of the basic head can then be decided. Once this basic head weight is known the amount of weighting material to be distributed according to the invention is determined and as stated earlier it is an advantage to have as much weighting material as possible available for re-distribution. It should not be thought that the weighting material must necessarily be distributed equally at the peripheral side portions. It has been found that in one embodiment, for example, of the weighting material available for distribution about 62% was placed at the toe and about 38% placed at the heel. These figures, however, are guidelines only and other distributions can be chosen depending on the particular shape of the head. Moreover it should be noted that as shown in FIGS. 1, 2 and 3 and to a lesser extent in FIG. 12 it is possible that the bulk of the main body portion may be offset from the center-line 4 in a direction rearwardly of the striking face 9 but at the same time the center of gravity of the head may be positioned in accordance with the invention to be either in substantial alignment with the shaft center-line or rearwardly of the shaft center-line towards the back of the club head.

It should be noted that the meaning of inertia as used in this specification is the accepted one of the property of an object to remain moving in the same direction unless acted upon by some outside source and the area moment of inertia I equal to $Inn + Ah^2$ in so far as it relates to the distribution of the weighting material, has been taken to be a measure of the club head's ability to resist the tendency to twist due to an off-center hit. For example, and by way of further explanation, it should be noted that in those cases where the section (or sections) concerned are displaced from the main axis the Theorem of Parallel Axes is used to determine the Area Moment of Inertia. For example in the case of golf club heads one can consider the theoretical or intended flight line (Z—Z) to be the axis X—X and the Area Moment of Inertia about this axis is given by the formula $Icg + Ah^2$ where Icg is the self inertia of the displaced section, A is the area of the displaced section and h is the distance from the axis X—X (in this case the flight line) to the centroid of the displaced section. It will be appreciated that the Area Moment of Inertia is concerned with plane surfaces such as that shown in FIG. 2 which can be considered a sectional plan view through the club head. However, the depth dimension of the weighting elements can be considered to be made up of an infinity of surfaces such as that shown in FIG. 2 and the sum total of this infinity of surfaces results in the formation of a discrete weighting element. Therefore by ensuring that each sectional surface has its own Area Moment of Inertia maximized, the rotational inertia, per se, is increased. Since the density of the weighting material will be very much greater than the parent material the outward lying weighting elements will have a greater effect on the rotational inertia of the head notwithstanding the greater area of the parent material at any one section.

Figure 26:
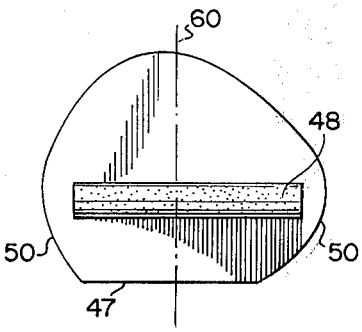

With regard to the soleplate it is pointed out that the thickened portions 48 need not always be spaced from the flight line to thereby increase the inertia effect and FIG. 26 illustrates a soleplate having the thickened portion 48 extending substantially from one peripheral side to the other and parallel with the striking edge 47. If desired it can be taken right out to form part of the side edge 50 of the soleplate and can contain additional weighting material heavier than the parent soleplate material as previously described. The soleplates, of course will be attached in the normal method using screws and in the case of the soleplate illustrated in FIG. 26 this forms a convenient method of biasing the weight of the soleplate towards the striking edge 47 and thus when attached to a golf club head can be adapted to align the center of gravity of the golf club head with the shaft center-line.

Figure 17:
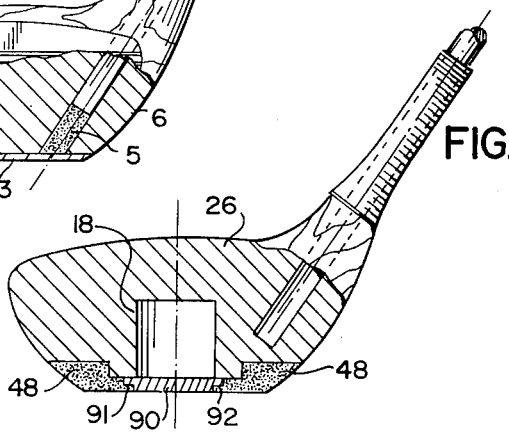
FIG. 17 is a sectional elevation taken along the shaft center-line of another embodiment of the invention.

As previously stated the main body portion 26 of the golf club head may have a cavity 18 therein and in those cases where the soleplate 43 is bifurcated as shown in FIG. 25 the cavity 18 will open outwards from the bottom of the club. This may be objectionable and FIG. 17 shows how this cavity may be covered by a closure member 90. The inside periphery of the legs 93, FIG. 25, of the soleplate can be shaped to form a spigot, generally indicated at 91 in FIG. 17 and which receives a flange piece 92 formed on the closure member 90. The soleplate will be attached to the bottom of the club by screws in the usual manner and of course will also retain the closure member in place. It should be noted that it would be advantageous if the material of which the closure member 90 is made has a low co-efficient of friction since this will help reduce the frictional drag when it comes into bearing contact with the turf during playing of a shot or during the takeaway initiating the swing. It will be a further advantage if the material of the closure member is lighter in density than the parent soleplate material since, in this way, the increased rotative inertia effect of bifurcating the soleplate will not be completely lost.

As previously taught the swingweight of a golf club may be altered in accordance with the methods outlined herein without changing the weight of the golf club head or changing the shaft flex and this may be done by pre-determining the position of the center of gravity relative to the bottom of the club head. In FIG. 15, for example, the weighting material 5 may be in the form of screwed inserts, received within a screwed recess and retained against the screw by a spring. The inserts may then be screwed up or down relative to the bottom of the club and thus effectively alter the swingweight.

In constructing golf club heads and golf clubs according to the invention described herein I believe the best method of obtaining the optimum weight distribution is by constructing prototypes and assembling and testing the resulting clubs on a driving machine. The ball is displaced a pre-determined distance from the theoretical flight line and the dispersal of the resulting shots is measured for clubs with various weight distributions.

Having described my invention and the best mode and manner of practicing it as required by the Patent Statutes, I desire that my invention be limited only by the following claims.

The embodiments of the invention in which an exclusive property or privilege is claimed are defined as follows:

1. A golf club head comprising:

a. a main body portion of a parent material of predetermined density having shaft attachment means for the attachment of a shaft thereto;

b. said main body portion having a front striking face, a rear surface, a sole surface, a top surface and toe and heel portions;

c. said heel and toe portions defining peripheral side portions of said main body portion;

d. a plurality of weighting elements having an outer and inner surface with said outer surface located adjacent to and forming a part at least of said peripheral side portions and blended therewith, said inner surface following generally the contour of said outer surface;

e. each of said weighting elements being of a material having a density greater than said parent material;

f. each of said weighting elements having a similar predetermined shape and substantially symmetrically located about a predetermined vertical plane substantially centrally located in said main body portion which defines the intended flight line, said elements being spaced from said flight line;

g. each of said weighting elements located a predetermined distance from said sole surface and extending a predetermined distance rearwardly of said striking face; said elements having a cross-section wherein the major dimension extends substantially parallel with said flight line and h. said weighting elements provide the club head with a center of gravity located a predetermined distance above said sole surface and a maximized area moment of inertia.

2. A golf club head according to claim 1 wherein the center of gravity of said head is located in said plane and said weighting elements are configured to position said center of gravity relative to said striking face.

3. A golf club head according to claim 2 wherein said weighting elements have a first end and a second end, said first end being heavier than said second end, and wherein said second end is located adjacent said striking face such that the center of gravity of said head is positioned between an extension of said center line and said rear surface.

4. A golf club head according to claim 2 wherein said shaft attachment means includes a center line substantially coincident with a shaft to be fitted thereto and wherein the center of gravity of said head is positioned substantially in alignment with an extension of said center line.

5. A golf club head according to claim 4 wherein said weighting elements have a first end and a second end, said first end being heavier than said second end, and wherein said first end is located adjacent said striking face such that the center of gravity of said head is located substantially in alignment with said extension of said center line.

6. A golf club head according to claim 2 wherein said outer surface diverges towards said striking face.

7. A golf club head according to claim 1 wherein said outer surface is generally strip like in form and substantially parallel with said sole surface.

8. A golf club head according to claim 1 wherein said outer surface forms a generally elongate strip extending in a plane substantially vertically of said sole surface.

9. A golf club head according to claim 1 wherein said weighting elements have an upper end and a lower end, said lower end being heavier than said upper end, and wherein said lower end is located adjacent said sole surface whereby the center of gravity of said head is located adjacent said sole surface.

10. A golf club head according to claim 1 wherein said predetermined center of gravity distance is within a range of about 0.8 to 0.85 inches.

11. A golf club head according to claim 1 including a restraining member extending around said rear surface and connecting said weighting elements.

12. A golf club head according to claim 11 wherein said restraining member is of resilient material.

13. A golf club head according to claim 12 wherein said weighting elements are removably attached to said head by means of said restraining member.

14. A golf club head according to claim 1 wherein said head is of the wood type and wherein said shaft attachment means comprises a hosel member for said head, said weighting elements comprising elongate members located intermediate said top surface and said sole surface and having predetermined cross-sectional dimensions whereby said area moment of inertia is maximized.

15. A golf club head according to claim 1 wherein said weighting elements are of a substantially constant thickness extending into said main body portion short of said flight line and being of a predetermined depth.

16. A golf club head according to claim 1 wherein said striking face is substantially flat.

* * * * *